United States Patent [19]

Hartbauer et al.

[11] 4,026,752

[45] May 31, 1977

[54] TAIL SECURING APPARATUS

[75] Inventors: Ellsworth A. Hartbauer, Concord; Rudolf R. Weis, Antioch, both of Calif.

[73] Assignee: Crown Zellerbach Corporation, San Francisco, Calif.

[22] Filed: Nov. 1, 1971

[21] Appl. No.: 194,159

[52] U.S. Cl. ..... 156/457; 156/357; 156/539; 156/578

[51] Int. Cl.[2] ..... B32B 31/00

[58] Field of Search ..... 156/446, 429, 450, 191, 156/295, 546, 547, 548, 549, 187, 457, 357, 539, 578; 222/485, 341

[56] References Cited

UNITED STATES PATENTS

| | | | |
|---|---|---|---|
| 3,134,706 | 5/1964 | Alexander | 156/359 |
| 3,332,580 | 7/1967 | Spencer et al. | 222/485 X |
| 3,393,105 | 7/1968 | Tellier, Jr. | 156/446 X |
| 3,426,944 | 2/1969 | French | 222/341 |
| 3,553,055 | 1/1971 | Janik | 156/429 X |
| 3,616,034 | 10/1971 | Obergfell | 156/295 |

*Primary Examiner*—Charles E. Van Horn
*Assistant Examiner*—Basil J. Lewris
*Attorney, Agent, or Firm*—Thomas R. Lampe; Corwin R. Horton

[57] ABSTRACT

Method of and apparatus for securing the tail or outer terminal convolution of a toilet tissue cant or similar roll product to the convolution immediately subjacent the tail. The tail of the roll product is secured by means of adhesive, and the method includes the step of ejecting a predetermined quantity of adhesive directly onto the subjacent convolution of the roll product while the tail is unwound therefrom. The adhesive is distributed along the length of the cant at spaced apart locations adapted to underlie the rewound tail, thereby allowing the tail to be adhesively secured to the cant. The apparatus includes adhesive applicator structure comprising a plurality of modules each of which is releasably secured to the apparatus so that it can be removed therefrom and replaced as an integer; and each adhesive applicator module includes a plurality of dispensing nozzles operative to eject a measured quantity of adhesive onto a cant underlying the same. The apparatus is fully adjustable to enable the angular location of the adhesive pattern to be changed relative to the length of the tail intended to overlie the same, and to enable the adhesive pattern to be oriented axially along the length of the cant in accordance with the size of the individual rolls into which it is to be subdivided.

7 Claims, 25 Drawing Figures

INVENTORS
ELLSWORTH A. HARTBAUER
& RUDOLF R. WEIS
BY John W. Graham
ATTORNEY

INVENTORS
ELLSWORTH A. HARTBAUER
& RUDOLF R. WEIS
BY John W. Graham
ATTORNEY

INVENTORS
ELLSWORTH A. HARTBAUER
& RUDOLF R. WEIS
BY John W. Graham
ATTORNEY

INVENTORS
ELLSWORTH A. HARTBAUER
& RUDOLF R. WEIS
BY John W. Graham
ATTORNEY

INVENTORS
ELLSWORTH A. HARTBAUER
& RUDOLF R. WEIS
BY John W. Graham
ATTORNEY

TAIL SECURING APPARATUS

This invention relates to an improved method of and apparatus for securing the tail or outer terminal convolution of a roll product to the subjacent underlying convolution thereof, and it has utility with roll products that may take variant forms including paper towelling, toilet tissue, and the like. A cant of toilet tissue may be taken as an exemplary roll product, and the tail thereof is conventionally secured to the convolution underlying the same subsequent to the web rewinding operation in which the cant is wound from a web withdrawn from a large supply roll and prior to the packaging operation in which the cant is subdivided into a plurality of individual rolls of tissue that are then enclosed within wrappers therefor.

As explained in U.S. Pat. No. 3,393,105 which issued July 16, 1968 to Clair W. Tellier, Jr., in paper converting operations in which roll products in sizes for commercial sale are rewound from a large parent or supply roll, one of the many problem areas is that of securing the tail or outer terminal convolution of the rewound roll product to the contiguously subjacent convolution prior to the cant being advanced into severing and wrapping machinery in which the relatively long cant (or log, as it is sometimes called) is segmented into a plurality of small rolls which are then wrapped for shipment and sale. If the tail of the roll product is not secured to the underlying convolution, the severing and wrapping operations may not be properly performed, in which event the wrapping machinery may jam or, if the wrap is successfully performed, excess paper from the roll product may extend from the wrapper, thereby resulting in an unsightly package.

The aforementioned patent No. 3,393,105 discloses apparatus for adhesively securing the tail of such roll product to the immediately underlying convolution, thereby obviating the prior requirement for the presence of personnel whose function it is to manually secure the free tail to the roll product prior to delivery thereof into the severing and wrapping machinery. Although the apparatus disclosed in such patent is in general quite satisfactory, there are certain characteristics of the apparatus that could be advantageously improved, and a general object of the present invention is to provide an improved apparatus of the type disclosed in the aforementioned patent for adhesively securing the tail of a roll product or the like to an underlying subjacent convolution.

Further objects, among others, are in the provision of an improved method and apparatus of the character described in which measured or predetermined quantites of adhesive are ejected directly onto the roll product when the tail is unwrapped therefrom; in which the apparatus has adhesive aplicator structure that is convenient to service and to repair and is adjustable so as to enable the apparatus to readily accommodate cants that are to be subdivided into individual rolls of different lengths, and that is equipped with nozzle structure operative to distribute an adhesive pattern directly onto the cant rather than onto the unsecured tail thereof so as to provide a cleaner operation having less waste and inconvenience than that present in apparatus in which the adhesive pattern is deposited onto the unsecured tail; in which the apparatus has adjustment means that are convenient and easy to use for the purpose of varying the length of the flap in relation to the adhesive pattern, has a single gaseous discharge system for unwinding the tail from the cant, and has a simple ejection system for displacing a completed cant from the apparatus; and in which the apparatus is structurally simple but positive and reliable in its performance.

Additional objects and advantages of the invention, including those of particularized character, will become apparent hereinafter as the specification continues.

An embodiment of the invention is illustrated in the accompanying drawings, in which.

Figure 1:
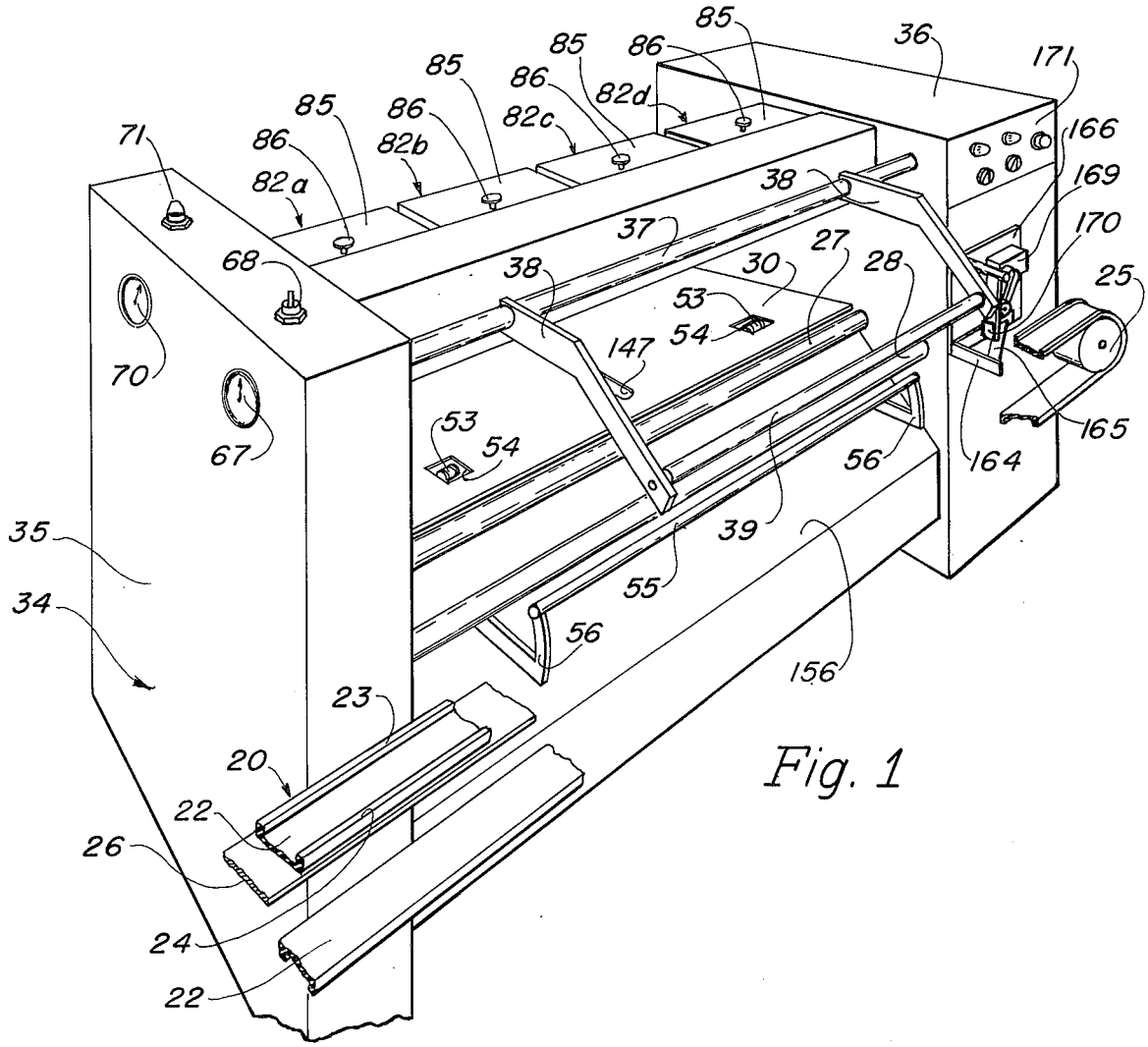
FIG. 1 is a perspective view of apparatus embodying the present invention.
Figure 9:
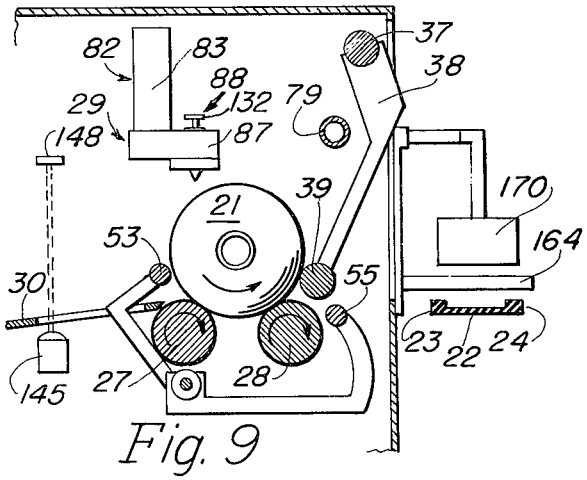

The over-all apparatus illustrated in FIG. 1 includes an infeed conveyor generally designated with the numeral 20, and which conveyor in the case of the roll product being a cant or log of paper tissue may be provided by the rewinding apparatus on which such cants are formed. The conveyor 20 is operative to successively advance cants 21 generally from left to right (as viewed in FIG. 1) to a location at which the cant is displaced from the conveyor and into the operating station of the apparatus, as depicted in FIG. 9 of the drawings. The conveyor apparatus may be completely conventional as respects the present invention, and as shown in FIG. 1 it includes an endless belt 22 having raised longitudinal edge portions 23 and 24 which prevent a cylindrical roll product such as the cant 21 from rolling from the belt. The endless belt 22 is entrained about the usual drive and idler rollers, such as the idler roller 25 shown in FIG. 1. A support pad or platform 26 may be disposed along the undersurface of the forwardly advancing top leg or reach of the belt to cooperate therewith in supporting the weight of each cant 21.

The roll product 21 may be wound from a web of any suitable material as, for example, cloth of either natural or synthetic fibers, plastic materials, metallic foils, and paper - either single layer or multiple-layer laminate. As a specific example, the roll product 21 may be a cant of toilet tissue which will be cut into toilet roll widths and then enclosed in appropriate wrappers after the tail of the cant has been secured to the convolution underlying the same. The roll product or cant 21 may be of any suitable length, and the apparatus is designed to accommodate predetermined maximum lengths. As concerns a cant of toilet tissue, the length thereof depends upon the characteristics of the rewinding machinery and there is no particular standard in the paper industry. However, typical lengths are 55, 66, 90, and 92 inches.

Figure 10:
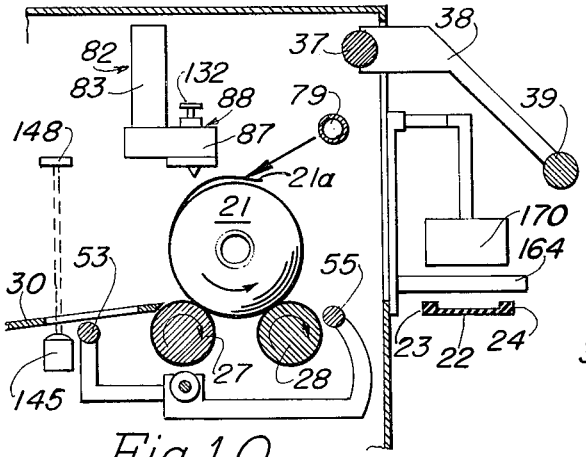

The tail-securing apparatus includes a single operating station at which the cant 21 is located during the time that all of the various functions are performd thereon that consummate in the tail of the cant being secured to the immediately subjacent convolution. Such station is illustrated in FIGS. 9 and 10 by the location of the cant 21, and it is defined at least in part by a pair of longitudinally extending, transversely spaced and substantially parallel rollers or shafts 27 and 28 that are continuously rotating in clockwise directions, as viewed in these figures, and receive and support the cant 21 thereon. In a functional sequence, the cant is displaced from the infeed conveyor 20 into the operating station upon the shafts 27 and 28 so as to be rotated thereby in a counter-clockwise direction. As the cant is rotated, the tail or free end portion 21*a* thereof is upwrapped therefrom, and an adhesive is applied to the cant at an adhesive station generally denoted with the numeral 29. The tail is then wrapped or wound about the cant and is thereby adhesively secured to the underlying convoluton onto which the adhesive is applied. The cant 21 is thereafter displaced laterally from the operating station to a discharge mechanism including, in the particular apparatus shown, an inclined chute or platform 30.

The discharge apparatus, which is not shown, in the case of toilet tissue cants delivers the same to cutting or severing apparatus which operates to subdivide the long cants into roll widths from which the plurality of successive rolls are delivered to wrapping mechanism at which the individual rolls are enclosed within a cellophane or other wrapper. All such mechanism may be completely conventional as respects the present invention, and the inclined platform or chute 30 may be taken as the infeed thereto.

The tail-securing apparatus includes frame structure of standard and appropriate character generally indicated in its entirely by the numeral 34. It will be understood that such frame structure comprises the usual channels, brackets, end walls, and similar elements; and since arrangements of this type are old and very well known, the frame structure will not be described in detail and the various elements thereof will simply be considered to be a part of such composite frame structure with the exception of the end components 35 and 36 which are separately indicated for purposes of orientation and may on occasion be referred to hereinafter as the pneumatic end and electrical end. The infeed conveyor 20 is disposed along the infeed side of the apparatus, and the support element 26 is welded or otherwise fixedly secured to the frame structure 34.

Figure 8:
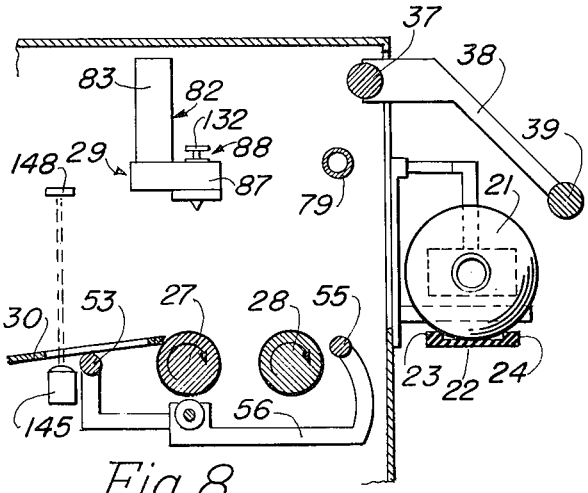
FIGS. 8 through 15 are diagrammatic views respectively illustrating successive operations in a complete functional cycle of the apparatus.

Extending between the end components 35 and 36 and journalled for rotation with respect thereto at an elevation substantially above the infeed conveyor 20 and in spaced relation is a rod or shaft 37 equipped at longitudinally spaced locations therealong with a pluraltiy of pusher arms 38 which are constrained upon the shaft (such as by means of clamp collars) so as to rotate therewith and to be prevented from axial displacements relative thereto. The pusher arms project outwardly and downwardly from the shaft 37, and at their lower outer ends they are connected together by a pusher bar 39. As shown in FIG. 8 the pusher bar 39 in one position thereof is located a spaced distance above and outwardly from the conveyor 20 and any cant 21 supported thereon, and such location of the bar may be considered to represent the cant infeed position thereof.

However, the pusher assembly defined by the shaft 37, arms 38, and bar 39 is adapted to be rotated or displaced angularly in a clockwise direction (as viewed in FIG. 8) from the infeed position shown in this Figure into the position shown in FIG. 9 wherein the pusher bar 39 has traversed an arcuate path of the order of 45° and is disposed inwardly of the conveyor 20 and at about the same location as the belt 22 thereof. The function performed by the pusher assembly in traversing such arcuate path is to displace a cant 21 from the infeed conveyor 20 and into the operation station at which it is supported upon the shafts 27 and 28. Following such displacement of a cant into the operation station, the pusher assembly is returned to its initial cant-infeed position shown in FIG. 8 preparatory to the next successive cant being delivered to the apparatus by the infeed conveyor 20 for displacement by the pusher assembly from the infeed conveyor and into the operation station.

Figure 5:
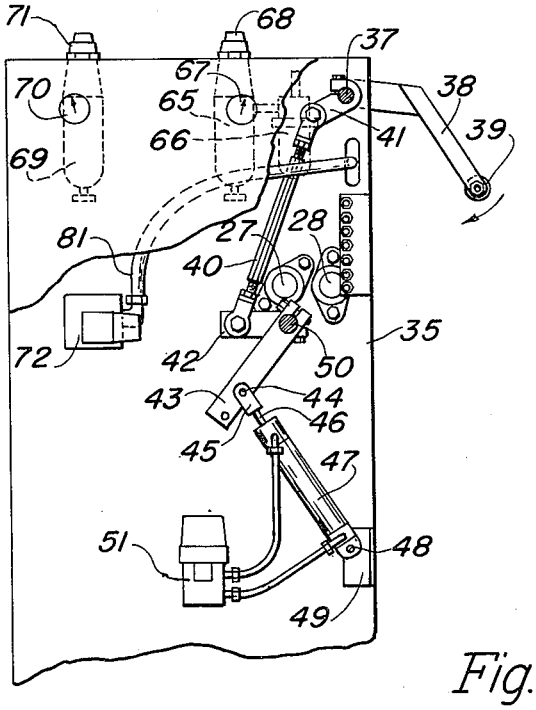
FIG. 5 is generally an end view in elevation of the apparatus taken essentially along the line 5—5 of FIG. 3, but with the cover plate of the apparatus removed to illustrate certain of the pneumatic components.

Angular reciprocable displacements of the pusher assembly are effected by drive mechanism (see FIG. 5) that includes an adjustable link 40 pivotally secured at its upper end to a clamp collar 41 fixedly attached to the shaft 37 adjacent the end thereof projecting into the pneumatic end 35 of the apparatus. The link 40 at its lower end is pivotally secured to one arm 42 of a bell crank having a second arm 43, the latter of which is pivotally secured (as shown at 44) to a clevis 45 attached to the outer end of the rod 46 of a reciprocable piston mounted within a cylinder 47 pivotally secured at its lower end (as shown at 48) to a mounting bracket 49 provided by the frame component at the pneumatic end thereof. The arms 42 and 43 of the bell crank are separate rather than integral components but each is adjustably clamped to a longitudinally extending shaft 50 extending longitudinally of the apparatus in generally parallel relation with the aforementioned shaft 47 and similarly jounalled for rotation adjacent its opposite ends in the end components 35 and 36 of the apparatus.

The piston-cylinder structure comprising the cylinder 47 is a fluid motor which is double-acting and is supplied with actuating fluid through a solenoid-controlled valve 51 connected to the cylinder adjacent opposite ends thereof. Accordingly, depending upon the condition of the solenoid-controlled valve, fluid under pressure (air in the particular apparatus being considered) is delivered to the cylinder 47 to cause the piston therewithin to be displaced toward, and then maintained in, one or the other of the end portions of the cylinder. Thus, in the condition of the apparatus shown in FIG. 5, air under pressure is supplied to the upper inner end of the cylinder 47 so as to retract the piston therein with the result that the pusher assembly including the shaft 37, arms 38 and bar 39 are in the infeed position so that a cant 21 can be delivered to the apparatus by the infeed conveyor 20. Whenever the solenoid-controlled valve 51 is conditioned to supply fluid to the lower outer end of the cylinder 47 and to relieve the pressure at the upper inner end thereof, the piston and rod 46 thereof will be extended, whereupon the arm 43 and shaft 50 will be displaced angularly in a clockwise direction, thereby causing the arm 42 to be similarly displaced in a clockwise direction along with the shaft 50, with the result that the link 40 is displaced upwardly to cause the clamp collar 41 and shaft 37 to be displaced anguarly in a clockwise direction. As a result, the pusher assembly will be displaced into the position shown in FIG. 9 to advance a cant 21 from the infeed conveyor into the operating station of the apparatus. Thereafter, the solenoid-controlled valve 51 will be conditioned to cause the piston and rod 46 to be retracted so as to return the various described components associated therewith into the relative positions illustrated in FIG. 5.

Figure 3:
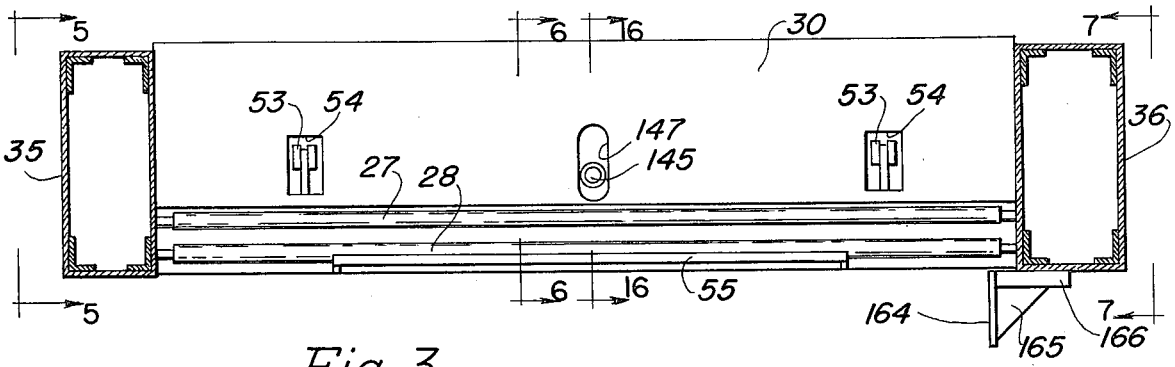
FIG. 3 is a longitudinal sectional view taken along the line 3—3 of FIG. 2.

Proper location of the cant or roll product 21 at the operating station defined by shafts or rollers 27 and 28 requires coaction with the pusher assembly of stop mechanism which prevents the cant from being displaced beyond the operating station or past the shafts 27 and 28 toward the left, as viewed in FIGS. 8 and 9. Such excessive displacement of the cant 21 might result as the consequence of the combined motions being imparted to the cant which aggregate: first, the inward displacement thereof effected by the pusher assembly; and second, the angular motion effected by rotation imparted to the cant by the rollers 27 and 28. In the apparatus being considered, the stop mechanism comprises a plurality of longitudinally spaced stop elements or arms 53 (there being two such arms in the apparatus, as shown in FIGS. 1 and 3) disposed between the end components 35 and 36 and respectively adapted to be projected and retracted through openings 54 provided for this purpose in the platform 30. The stop elements are adjustably clamped to the aforementioned shaft 50 so as to rotate therewith. Accordingly, the stop elements 53 are displaced in mechanically enforced synchronism with the pusher assembly, and are projected through the openings 54 to engage a cant 21 and prevent excessive dislacement thereof by the pusher mechanism whenever the pusher mechanism is displaced inwardly, as shown in FIG. 9. Evidently, the stop elements 53 are retracted through the openings 54 to a location below the platform 30 whenever the pusher assembly is returned to its infeed position, as shown in FIG. 10.

Figure 6:
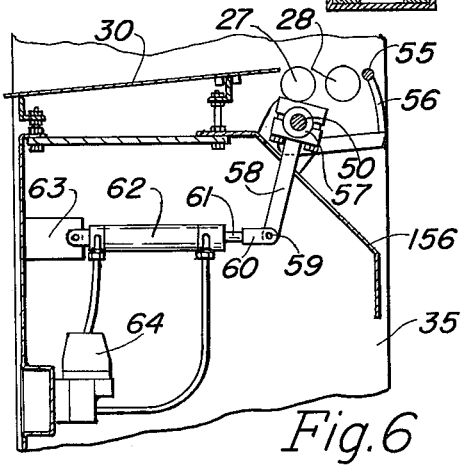
FIG. 6 is a broken transverse sectional view taken along the line 6—6 of FIG. 3.

After the tail of a cant 21 has been secured to the cant convolution underlying such tail, it is necessary to discharge or eject the cant from the operating station or position defined by the shafts 27 and 28. Ejection is effected by ejection mechanism that includes a bar 55 oridinarily located, as shown best in FIGS. 1, 6, and 8 through 14, below the upper surfaces of the shafts 27 and 28 and supported at longitudinally spaced locations in generally parallel relation with the shaft 50 on L-shaped arms 56. The arms 56 are clamped to an elongated hollow sleeve 57 coaxially circumjacent the shaft 50, as shown in FIG. 6, and which sleeve is freely rotatable with respect to the shaft. Also clamped to the sleeve 57 intermediate the arms 56 at about the midpoint of the sleeve is a crank arm 58 having pivotally secured to the lower end thereof (as shown at 59) a clevis 60 attached to the outer end of a rod 61 forming a part of a piston (not shown) reciprocable within a cylinder 62. The cylinder 62 is pivotally attached to a bracket 63 supported by a component of the pneumatic end 35 of the apparatus. A solenoid-controlled valve 64 is connected to the opposite end of the cylinder 62 and selectively supplies pressurized fluid (compressed air in the apparatus being considered) to one end or the other of the cylinder 62 while relieving pressure at the opposite end thereof.

In the condition of the apparatus shown in FIG. 6, the ejection mechanism is in its retracted condition and does not impede displacement by the pusher mechanism of a cant from the infeed conveyor 20 onto the shafts 27 and 28, as depicted in FIG. 9. At this time, the solenoid-controlled valve 64 is supplying pressurized fluid to the inner end of the cylinder 62 so as to retract the piston and rod 61 thereof. When pressurized fluid is supplied to the piston or outer end of the cylinder 62, the piston rod 61 is extended, the crank arm 58 and sleeve 57 are displaced in a counter-clockwise direction, as viewed in FIG. 6, so as to displace the arms 56 and bar 55 in a counter-clockwise direction, thereby causing the bar to engage a cant 21 supported on the shafts 27 and 28 so as to eject such cant from the operating station and onto the platform 30, as shown in FIG. 15. Thereafter, the fluid motor comprising the cylinder 62 is energized in the reverse direction to return the ejection mechanism into the retracted position thereof shown in FIGS. 8 through 14.

The two air motors respectively comprising the cylinders 47 and 62 are supplied with compressed air via the respectively associated solenoid-controlled valves 51 and 64 from a suitable compressed air supply provided by the factory at which the apparatus is located. The compressed air is delivered to the cylinders 47 and 62 via a pressure regulator 65 and lubricator 66 of conventional design and operation. The pressure regulator 65 may be equipped with a gauge 67, and it may have an adjustment control 68 accessible from the exterior of the end component 35, as is evident in both FIGS. 1 and 5. For purposes of simplification. The conduits connecting the solenoid-controlled valves 51 and 64 with the regulator-lubricator assembly 65, 66 are not shown. It may also be noted that pressure-regulated and lubricated air from the assembly 65, 66 is also supplied to air motors via solenoid-controlled valves forming a part of the adhesive applicator structure which will be described in detail hereinafter. Further, the apparatus includes an additional pressure regulator 69 equipped with a gauge 70 and ajustment control 71 accessible from the exterior of the component 35, and pressure-regulated air from the regulator 69 is supplied without lubrication via a solenoid-controlled valve 72 to gaseous discharge means comprised by tail accelerating mechanism operative to unwind the tail from the cant 21, as will be described in detail hereinafter.

Figure 7:
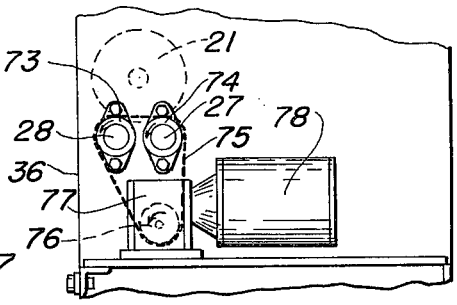
FIG. 7 is generally an end view in elevation, partly broken away, of the apparatus taken essentially along the line 7—7 of FIG. 3 but with the cover plate of the apparatus removed to reveal certain of the electric components.

The shafts or rollers 27 and 28 are jounalled for rotation at their opposite ends in bearings provided for this purpose in the end components 35 and 36 of the apparatus. At the electrical end component 36, the shafts 27 and 28 are elongated and are equipped with sheaves or drive pulleys 73 and 74, as shown in FIG. 7, which are keyed or otherwise secured to the shafts so as to prevent relative rotation. Entrained about the pulleys 73 and 74 is an endless belt 75 that is also entrained about a drive pully 76 mounted upon the output shaft of a gear reducer 77 operatively connected with a motor 78. The motor 78 functions whenever the apparatus is in operation to continuously drive the shafts 27 and 28 in the same angular directions, as indicated by arrows in FIG. 7. It might also be noted that a power transformer and static power unit (not shown) are located at the electrical end 36 and are used to supply potential to a static eliminator included in the apparatus, but of standard design and forming no part of the present invention.

The tail 21*a* of the cant or roll product 21 is unwound therefrom prior to the application of an adhesive to the cant, and such unwinding is accomplished by tail accelerating means located at the operating station of the apparatus. In more particular terms, the unwinding is accomplished by air under pressure directed toward the tail 21*a* from gaseous discharge means including a signal nozzle structure 79 extending along the cant generally from end to end of the apparatus, as shown best in FIG. 2. The nozzle structure is fixedly located and is in the form of an elongated hollow tubular manifold provided therealong with a plurality of longitudinally spaced apertures 80 that are inclined with respect to a horizontal plane at an angle of the general order of 45° so as to face downwardly and inwardly from a position slightly below the shaft 37 and inwardly thereof. The elongated nozzle structure 79 is connected through a conduit 81 (FIG. 5) with a source of compressed air via the solenoid-controlled valve 72, as heretofore explained.

Figure 11:
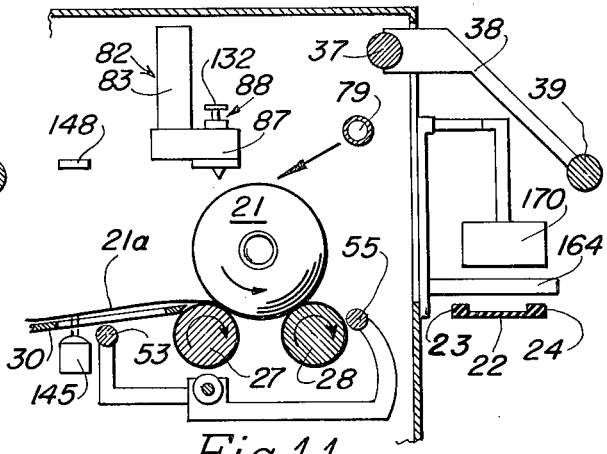
Figure 12:
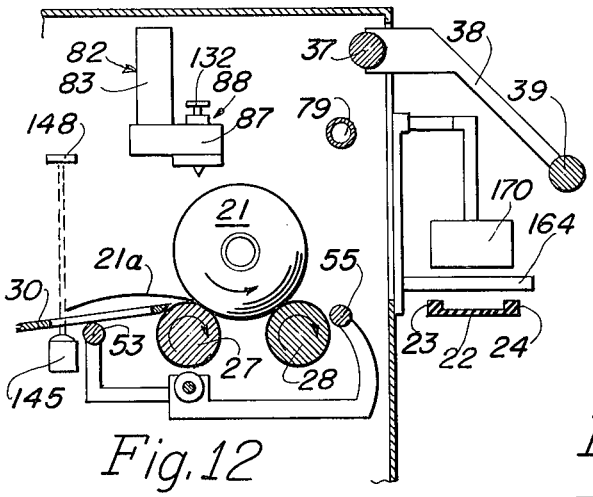

Referring to FIGS. 10 and 11, it will be seen that at a predetermined time during a cycle of operation, the solenoid-controlled valve 72 is operative to supply compressed air to the nozzle structure 79 which directs the compressed air through the longitudinally spaced apertures 80 toward the cant 21 at an angular inclination such that when the tail 21*a* is rotated into operative association with the air blast, it is unwound from the cant and extended along the platform 30 in substantially planar relation therewith, as is evident in FIG. 11. The supply of air to the nozzle structure 79 is then terminated until a subsequent cycle of operation where the described function is repeated when the next successive cant is delivered from the infeed conveyor 20 to the operating station. The gaseous discharge from the nozzle structure 70 passes over the cant tending first to lift the tail 21*a* therefrom by a negative pressure (as indicated in FIG. 10) and then to enter the space intermediate the tail and subjacent convolution to accelerate the tail by application thereto of a positive pressure force.

Figure 13:
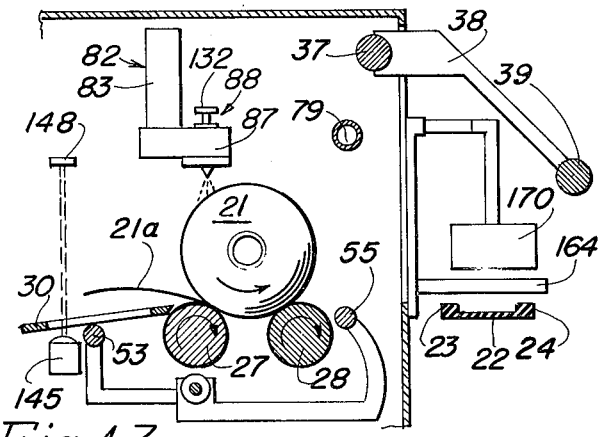

Adhesive is applied directly to the cant 21 rather than to the tail 21*a* thereof at a predetermined time in each cycle of operation of the apparatus, as indicated in FIG. 13. A measured quantity of liquid adhesive is discharged onto the cant, thereby obviating the presence of excessive adhesive, and also maintaining each cant of the apparatus relatively clean and adhesive-free since no adhesive-exposed areas of the cant or tail are pulled or drawn over portions of the apparatus which may also come into contact with exposed surfaces of a cant. Further, the adhesive employed is a water soluble adhesive so that rejected cants and rolls formed by subdividing the same can be recycled through a paper making process. The particular apparatus being considered has been found to function in an exceedingly satisfactory manner using a hot melt adhesive in the form of a water soluble wax applied at a temperature of from approximately 160° F. to 170° F.

Figure 4:
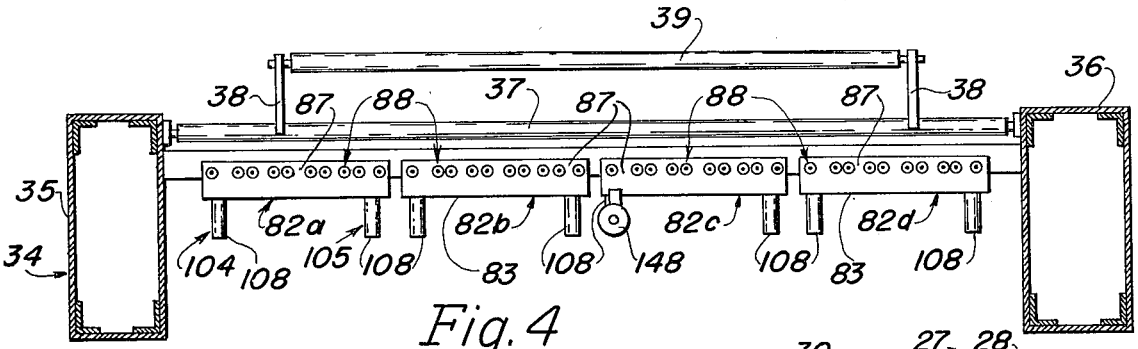
FIG. 4 is a longitudinal sectional view taken along the line 4—4 of FIG. 2.
Figure 19:
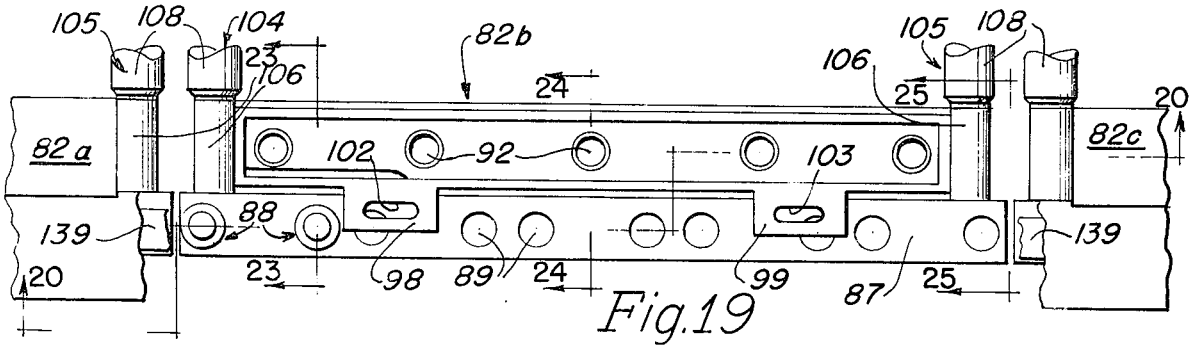
FIG. 19 is an enlarged, broken top plan view, partly broken away, of the adhesive applicator - the cover being removed from one such applicator to show the interior thereof.
Figure 20:
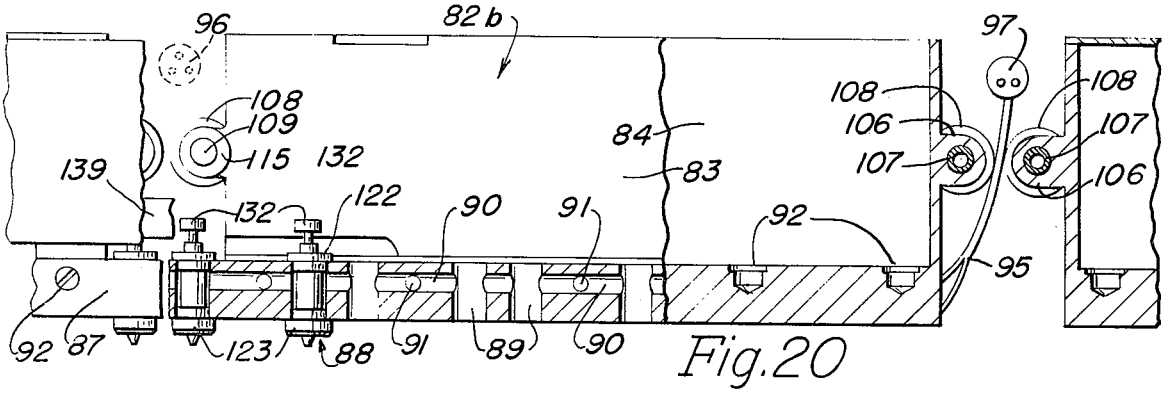
FIG. 20 is a broken longitudinal sectional view taken along the line 20—20 of FIG. 19.
Figure 21:
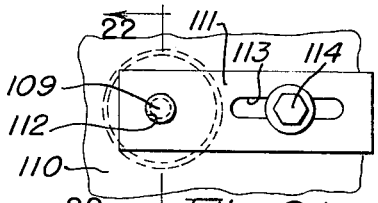
FIG. 21 is a broken vertical sectional view taken along the line 21—21 of FIG. 25.
Figure 22:
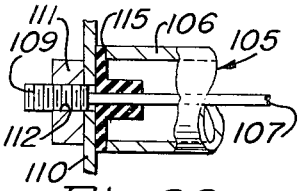
FIG. 22 is a broken vertical sectional view taken along the line 22—22 of FIG. 21.
Figure 23:
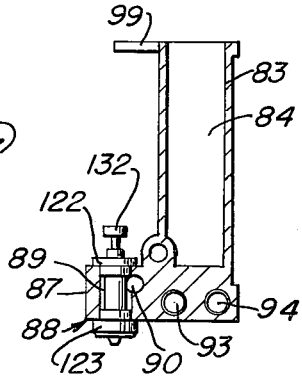
FIG. 23 is a vertical sectional view taken along the line 23—23 of FIG. 19.

The adhesive applicator structure is located at the operating station of the apparatus and, as is most evident in FIGS. 1, 4 and 19, it comprises a plurality of separate adhesive applicator units or modules respectively denoted with the numerals 82*a* through 82*d*, there being four such units in the particular apparatus illustrated. The individual units 82 may be identical, as respects the present invention, and they are removably mounted upon the apparatus so that any particular unit may be removed therefrom for servicing without disturbing the other units. Any such removal and replacement of a unit 82 is accomplished quickly and easily without the necessity of special tools and equipment, thereby enabling an entire defective unit to be replaced so that the apparatus can be returned to operation in a very short period (2 or 3 minutes, for example), as will become more evident hereinafter. Further, each unit 82 is longitudinally adjustable but is fixedly secured through the support means therefor to the frame structure of the apparatus in any position of adjustment, wherefore each unit 82 and the entire adhesive applicator structure comprising the same are spacially fixed in being constrained against longitudinal, transverse, and other bodily displacements during each cycle of operation, as subsequently explained in detail.

Figure 16:
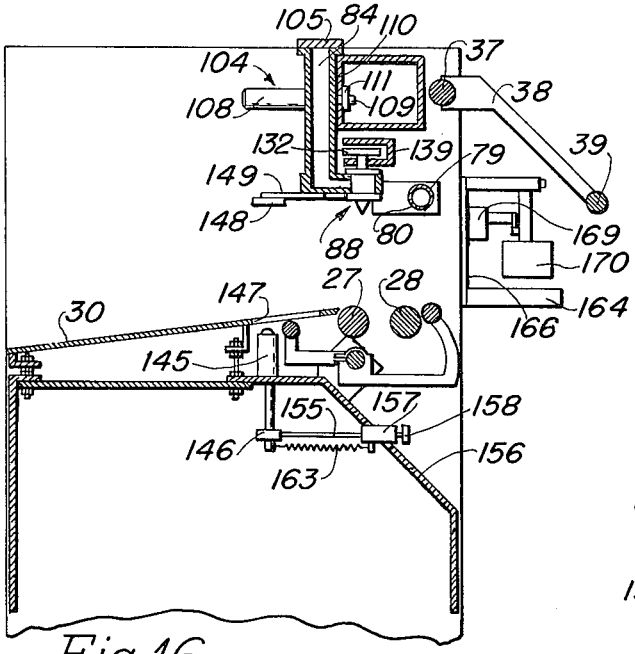
FIG. 16 is a broken transverse sectional view taken along the line 16—16 of FIG. 3.

Referring now to FIGS. 19 through 25 in particular, it will be seen that each module or unit 82 includes an elongated casing 83 of generally rectangular cross section and defining a relatively large reservoir 84 therewithin adapted to receive a quantity of adhesive so as to provide an available supply thereof. The casing 83 has upwardly extending side and end walls and is open at its top although a removable cover 85 (FIGS. 1 and 16) is provided in association with each casing so as to close the open upper end thereof except when it is necessary to provide access thereto forfilling. Each cover 85 may be equipped with a knob 86 to facilitate manipulation thereof, and in certain embodiments of the invention each cover 85 is hingedly secured to the casing 83 adjacent one end thereof. The lower end of the reservoir 84 is generally closed and a support structure 87 extends laterally from the casing adjacent the lower end of the reservoir, as is evident in FIGS. 23 and 24.

The support structure 87 in the form shown is a substantially continuous structure (see FIGS. 19 and 20), and it is adapted to support a plurality of dispensing nozzles 88 that are disposed therealong in spaced apart relation. More particularly in this respect, in the adhesive applicator modules 82, each is provided with ten such nozzles 88 arranged essentially in longitudinally spaced groups of two except at the ends of each module which provides but a single dispensing nozzle thereat. Accordingly, and as is most evident in FIGS. 19 and 20, a single nozzle 88 is located adjacent each end portion of the support structure 87 which projects beyond the longitudinal limits of the associated reservoir 84, and intermediate such end nozzles in a straight line within the longitudinal limits of the reservoir 84 are four longitudinally spaced pairs of dispensing nozzles. Each nozzle 88 is located within a vertically oriented bore 89 provided for this purpose in the support structure 87 forming a part of the associated unit 82, thereby enforcing a spacially fixed location on each nozzle 88 related to that of its associated unit 82.

Each of the bores or passages 89 is intersected by a longitudinally extending supply passage or adhesive-delivery manifold 90 extending substantially from end to end of the support structure 87. The manifold 90 may be drilled or otherwise formed in the support structure 87, and the ends of the manifold are closed so as to prevent escape of adhesive therefrom, as indicated by the plug 90*a* in FIG. 25. In open communication with the manifold 90 at longitudinally spaced locations therealong are a plurality of supply passages 91 that are tranversely disposed and may be formed by drilling through the support structure 87 so as to intersect the manifold 90 and project therebeyond into generally underlying relation with the reservoir 84. The inner ends of the supply passages 91 are respectively closed by plugs 92. At their inner ends, the passages 91 open into downwardly extending sumps or recesses 92 formed along the bottom of the reservoir 84 at longitudinally spaced intervals in alignment with the passages 91. Accordingly, adhesive within the reservoir 84 is continuously supplied via the sumps 92 and passages 91 to the manifold 90 which delivers such adhesive to the valve bores 89. Extending longitudinally through the casing 83 generally beneath the reservoir 84 are a pair of heater passages 93 and 94 adapted to have heating rods disposed there within that are electrically connected via conductors 95 (FIG. 20) to an appropriate outlet 96 provided for this purpose along the apparatus by a plug 97 removably received within the socket 96.

The plugs 97 permit the respectively associated modules 82 to be quickly disconnected electrically from the apparatus to facilitate removal and replacement of the modules. Also, the modules are mechanically supported by means facilitating such removal; and for this purpose each casing 83 is equipped at longitudinally spaced intervals therealong adjacent its upper end with inwardly projecting support tabs or brackets 98 and 99 (FIG. 19) that overlie a support shelf 100 (FIG. 25) forming a part of the frame structure of the apparatus. The support shelf 100 has locating pins 101 extending upwardly therefrom at longitudinally spaced locations for respective receipt within elongated slots or openings 102 and 103 respectively provided by the support brackets 98 and 99. It will be apparent that each module 82 is longitudinally movable along the frame structure of the apparatus and support shelf 100 thereof within the dimensional limits defined by the pins 101 within the elongated slots 102 and 103.

Support of each module 82 is also effected by a pair of longitudinally spaced handle structures 104 and 105 respectively disposed adjacent the opposite ends of each module along the outer surfaces of the end walls of the casing 83 but within the dimensional limits of the support structure 87. Each handle structure includes a cylindrical sleeve or collar 106 provided by the associated casing 83 within which is rotatably received a shaft 107 of small diameter (FIG. 2) having at its outer end an enlarged handle 108 of sufficient diameter that it is convenient to grip both for rotation and for lifting the entire module 82 providing the same. Adjacent its inner end, the shaft 107 is equipped with a threaded enlargement 109 extending outwardly therefrom so that it can pass through an opening provided for this purpose in a vertical wall element 110 formed integrally with or otherwise rigidly secured to the shelf 100. Located on the opposite side of the wall 100 is a longitudinally elongated nut 111 in the form of a bar having a threaded opening 112 adapted to receive the threaded enlargement 109 to enable the module 82 to be clamped thereby against the wall 110.

The nut 111 has a longitudinally elongated slot 113 therein that passes a fastener bolt 114 therethrough that is loosely secured to the wall element 110 so as to enable the bolt to be adjustably displaced therealong in longitudinal directions within the dimensional limits defined by the bolt 114 and slot 113. The enlarged handle 108 of the shaft 107 prevents the handle structure from being drawn through the collar 106 in one direction and also forces the collar toward the wall element 110 when the enlargement 109 is tightened into the threaded opening 112 of the nut 111. The shaft 107 is confined within the sleeve 106 so that it cannot be removed therefrom in the opposite direction by a stop fastener 115 slidably and rotatably mounted upon the shaft 107 and of sufficient diameter to overlie the end of the collar 106. The threaded enlargement 109 prevents the stop fastener 115 from being removed from the shaft 107, and the shaft is pinned to the handle 108 as shown at 116 in FIG. 25. The stop fastener 107 and handle 108 may be advantageously formed of a plastic material having relatively low heat conductivity.

Figure 18:
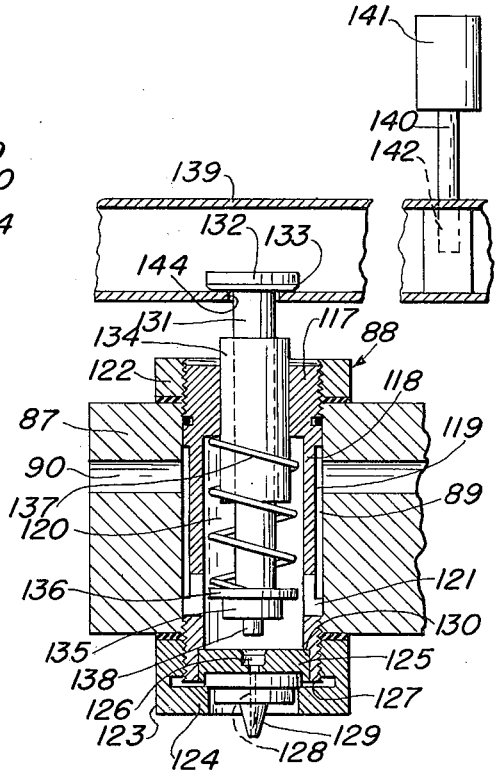
FIG. 18 is an enlarged sectional view of a discharge nozzle, the view being taken along the line 18—18 of FIG. 25.

The dispensing nozzles 88 are all substantially identical, and they embody valves selectively movable between closed and open positions and operative in the closed positions thereof to prevent discharge of adhesive. When the valves are displaced toward their open positions, a measured quantity of adhesive is permitted to enter a dispensing chamber from which such measured quantity is expressed when the valve is thereafter returned to its closed position. The details of the valve-equipped discharge nozzle structure for expressing predetermined quantities of adhsive onto each cant 21 are illustrated in FIG. 18, to which reference will now be made.

The nozzle structure 88 includes a generally cylindrical casing 117 dimensioned to fit into a bore 89 and having an intermediate portion 118 of reduced external diameter so as to define with the circumjacent surface of the bore 89 an annular chamber 119 in open communication with the adhesive supply passage 90. The casing 117 defines an axially extending cylinder 120 therewithin that at its lower end is in open communication with the annular chamber 119 via a plurality of angularly spaced inlet ports 121 of relatively large cross sectional area so as to permit adhesive to be delivered into the lower end portion of the cylinder 120 from the chamber 119 whenever the nozzle structure has the configuration shown in FIG. 18. The casing 117 is confined within the bore 89 by means of nut structures 122 and 123 respectively disposed adjacent the top and bottom of the casing so as to bear against the upper and lower surfaces of the support structure 87. The nut structures 122 and 123 respectively engage threaded end portions provided by the casing 117 adjacent the opposite ends thereof, and the lower nut structure 123 has an inwardly extending flange 124 that partially underlies the lower end of the casing.

In this respect, the casing 117 is equipped with a valve disc 125 having a central opening or measuring chamber 126 therein through which adhesive may be expressed. Underlying the valve disc 125 is a nozzle disc 127 having a restricted nozzle passage 128 in direct communication with the valve opening 126 and terminating at its lower end in a tapered nozzle 129. The casing 117 has a downwardly facing shoulder 130 against which the valve disc 129 seats, and the inwardly extending flange 124 of the nut structure 123 defines an upwardly facing shoulder that bears against the nozzle disc 127 so as to force the same into tight engagement with the valve disc and, thereby, to force the valve disc against the shoulder 130 of the casing. Accordingly, the lower end portion of the cylinder 120 is effectively closed by the valve disc 125 and nozzle disc 127 except for the flow passage therethrough defined by the valve opening or port 126 and nozzle passage 128 in communication therewith.

Mounted for reciprocable axial displacements relative to the casing 117 and cylinder 120 is a plunger or piston 131 equipped at its upper end with an enlarged head 132 that may be equipped along the underside thereofwith a fiber washer 133. More particularly, the plunger 131 is slidably reciprocable within an axially elongated bearing sleeve 134 extending through the upper end portion of the casing 117 and projecting downwardly into the cylinder 120. The bearing sleeve 134 may be confined within the casing 117 by any suitable means such as a press fit. The long length of the bearing sleeve stabilizes the plunger so as to prevent canting and binding thereof. At its lower end within the cylinder 120, the plunger 131 is equipped with a dispensing valve 135 having a laterally enlarged annularly flange 136 at its upper end defining a seat for the lower end of a helical compression spring 137 which, at its upper end, seats against the top wall of the cylinder 120. The spring 137 is coaxially circumjacent both the plunger 131 and bearing sleeve 134, and it resiliently biased the plunger and dispensing valve downwardly from the open position shown to a closed position in which the valve seats upon the upper surface of the valve disc 125.

The dispensing valve 135 is equipped centrally with a depending piston 138 in alignment with the measuring chamber 126 in the valve disc and dimensioned so as to be slidably displaceable thereinto. The plunger 131 in the elevated position shown in FIG. 18 allows adhesive to fill the measuring chamber 126 from the quantity of adhesive maintained within the lower end portion of the cylinder 120 because of its communication with the adhesive reservoir 84 via the inlet ports 121, annular chamber 19, supply manifold 90, supply passages 91, and sumps 92. When the plunger is displaced downwardly under the biasing force of the spring 137, the piston 138 enters the measuring chamber 126 and expresses the quantity of adhesive therein outwardly through the passage 128 and onto a cant 21 located at the operating station. This operation is illustrated in FIG. 13, and it will be observed therein as well as in other of the Figures that the nozzles are located slightly above a cant 21 and generally in alignment with the inner shaft. Accordingly, for each cyclic reciprocation of the plunger 131, a measured or predetermined quantity of adhesive is discharged from the dispensing nozzles 88 onto an underlying cant 21.

Figure 25:
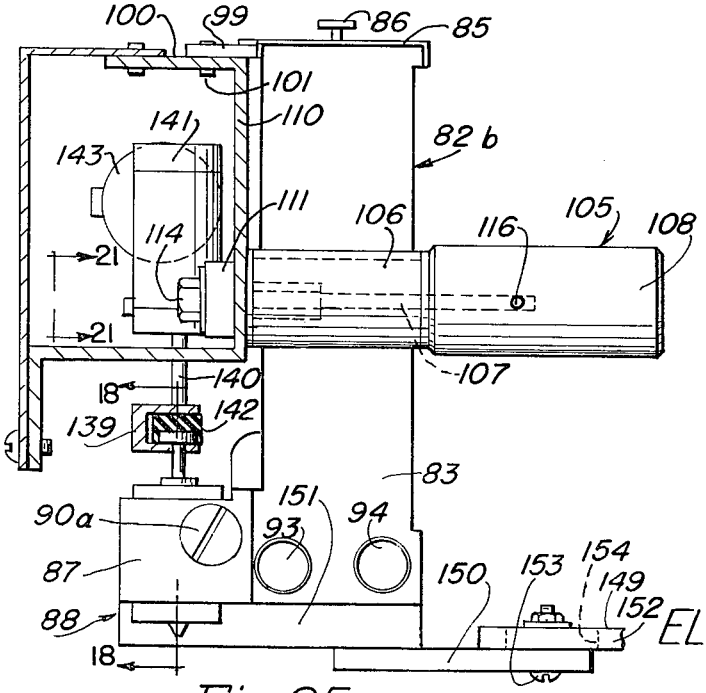
FIG. 25 is an enlarged vertical sectional view taken along the line 25—25 of FIG. 19.
Figure 24:
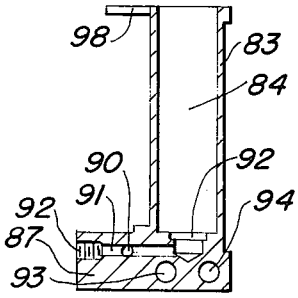
FIG. 24 is a vertical sectional view taken along the line 24—24 of FIG. 19.

Each of the dispensing nozzles 88 (there being ten for each of the four adhesive modules 82, or a total of 40) is operatively associated with a generally C-shaped actuator channel 139, as is shown most clearly in FIGS. 18 and 25. The channel 139 in the particular apparatus being considered is discontinuous and comprises four separate sections oriented in end to end alingment, each having substantially the same length as that of the support structure 87 of the associated adhesive module 82. The channel sections are positioned above the support structure 87 in substantially overlying alignment therewith, and each section is supported at longitudinally spaced locations by the depending rod 140 of a reciprocable piston disposed within a vertically oriented cylinder 141. Thus, a pair of cylinders 141 are provided for each channel section 139, and the piston rods 140 extend downwardly through an opening provided therefor in the upper flange of the channel section and are equipped therewithin with a large head 142 that substantially fills the entire vertical space between the upper and lower flanges of the channel 139 so as to positively raise and lower the same in accordance with the cyclic reciprocations of the piston rods 140. Each pair of fluid motors defined by the cylinders 141 and pistons reciprocable therewithin are operatively connected with a solenoid-controlled valve 143 that receives air under pressure from the aforementioned pressure regulator 65 and lubricator 66, and it functions to supply air alternately to the upper and lower end portions of each cylinder 141 so as to cause the same to raise the channel 139 and thereafter to lower the same.

As is seen best in FIG. 18, the plunger 131 of each discharge nozzle 88 is removably connected with the channel 139 and, more particularly, with the lower flange thereof which is provided therealong with a plurality of laterally disposed slots 144 that are spaced apart longitudinally and aligned with the respective plungers 131 so as to receive the same therein. The enlarged heads 132 of the plunger overlie the lower flange of the channel 139, thereby enabling the channel upon upward displacement thereof to elevate each associated plunger 131 to the position shown in FIG. 18 in which the measuring chamber 126 is opened to permit the same to fill with adhesive. When the air motors 141 are energized in a reverse direction, they positively displace the channel 139 downwardly which momentarily leaves the plungers 131 in their raised positions to be subsequently closed by the biasing force of the compression springs 137 operative thereon. Accordingly, although the air motors 141 and channel sections 139 positively raise the associated plungers 131, the plungers are returned to their closed positions independently of the channel sections under the resultant force of the springs 137.

Cyclic reciprocable displacements of the actuating channel 139 to cause the various discharge nozzles 88 to eject a measured quantity of adhesive onto an underlying cant are controlled by sensing means responsive to the position of the tail 21*a*. More especially, such sensing means comprises a photosensitive detector including, as shown best in FIGS. 8 through 15 and 16, a photoelectric tube or cell 145 supported by adjustable bracket mechanism generally denoted with the numeral 146 below the inclined platform 30. A transversely elongated opening 147 in the platform 30 permits the photosensitive device 145 to detect the presence and absence of a cant tail 21*a* along the platform 30, and light is concentrated and directed toward the device 145 by a mirror 148 supported in alignment therewith by arm structure 149 secured to the adhesive module 82*b* along the underside thereof. More particularly and as illustrated in FIG. 25, the arm structure 149 includes a support arm 150 welded or otherwise fixedly secured to a depending bar 151 provided by the casing 83 of the module along the undersurface thereof. The arm structure further includes an adjustable carrier arm 152 secured to the arm 150 by a nut and bolt assembly 153, the bolt of which extends through an elongated slot 154 in the arm 152 so as to permit relative displacements thereof with respect to the arm 150 within the dimensional limits defined by the bolt and slot. Accordingly, the location of the mirror 148 both in a transverse and angular sense can be adjusted to align the same with the photosensitive cell 145.

The cell 145 is also adjustable transversely or from front to rear of the apparatus so as to determine the length of the tail 21*a* that is wound into overlying relation with the adhesive pattern deposited onto a cant 21 by the discharge nozzles 88. Such adjustable displacements of the device 145 are provided by the aforementioned structure 146, as shown best in FIG. 16, which includes a shaft 155 extending transversely of the apparatus and through an inclined cover plate 156 thereof. The shaft 155 is threaded and threadedly engages a nut 157 fixedly related to the panel 156. To facilitate rotational adjustments of the shaft 155, it is equipped with a knob 158 adjacent the panel 156 along the outer surface thereof.

Figure 17:
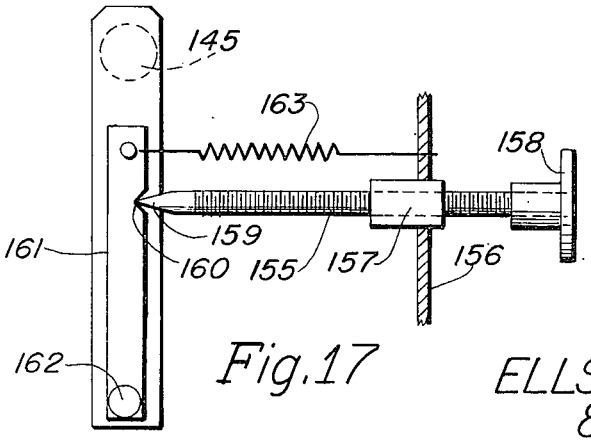
FIG. 17 is generally a top plan view of the adjustment assembly for the photoelectric sensor means shown in FIG. 16.

At its inner end, the shaft 155 has a prismatic or wedge-shaped end 159 configurated such that it is tapered in cross section in one direction, as seen in FIG. 17, and relatively long in the opposite direction (i.e., normal to the plane of the drawing) so as to be asymmetrical. The generally wedge-shaped end 159 in the position shown in FIG. 17 is adapted to seat within a V-shaped recess 160 defined along one side of an elongated pivot arm structure 161 supported intermediate the ends therof on a post or shaft 162 for angular displacements in either clockwise or counter-clockwise directions, as viewed in FIG. 17. Adjacent its outer end, the arm structure 161 supports the aforementioned cell 145 and determines the adjusted position thereof. The helical tension spring 163, secured at one end to the panel 156 via an ear provided for this purpose and at its other end to the arm 161 via a pin carried thereby, resiliently biases the arm in a counter-clockwise direction (as seen in FIG. 17), thereby tending to firmly seat the wedge-shaped end portion 159 of the shaft within the recesses 160.

It will be apparent that as the arm 161 is displaced angularly about the axis of the pin 162, the cell 145 will be displaced forwardly or rearwardly, as the case may be, thereby changing the position thereof within the opening 147 in the platform 30. The shaft 155 and knob 158 thereof must be rotated or turned through multiples of 180° whenever the position of the cell 145 is changed so as to enable the wedge-shaped end 159 of the shaft to seat within the V-shaped recess 160. Such seating engagement of the shaft end and recess serves as a safety lock to constrain the shaft against inadvertent rotational movements, and the composite construction of the arm structure serves an analogous purpose. By referring to FIG. 13 in particular it will be apparent (especially in view of the subsequent discussion) that when the cell 145 is adjusted toward the left (as viewed in this Figure), the tail end portion 21*a* of the cant 21 will be longer at the time adhesive is discharged onto the cant than when the cell is adjusted toward the right, the latter adjustment having the effect of reducing the length of the tail.

Figure 2:
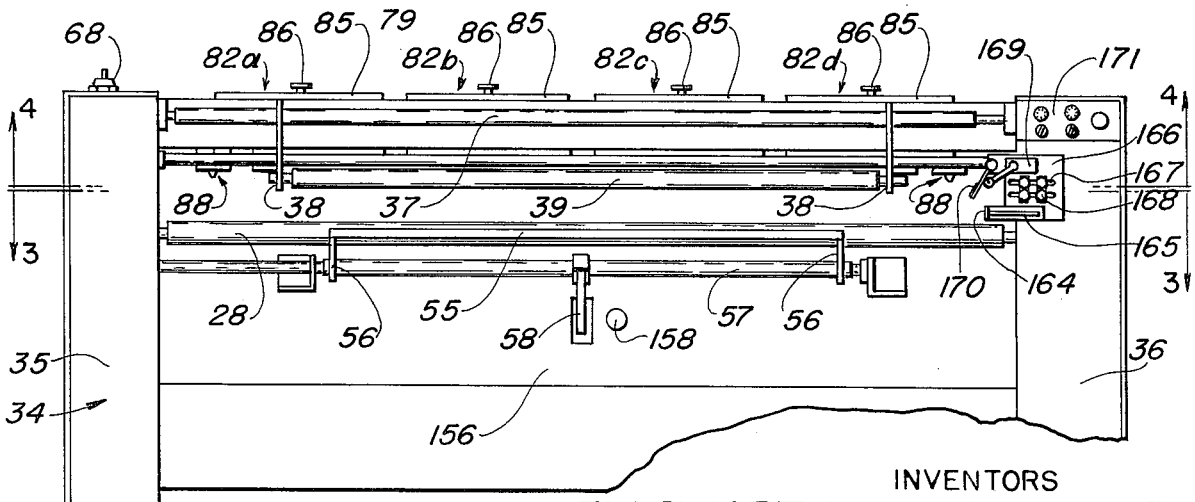
FIG. 2 is a broken front view in elevation of the apparatus seen from the infeed side thereof.

Considering FIGS. 1 and 2 in particular, it will be observed that the apparatus is equipped with switch and limit structure in operative association with the infeed conveyor 20. More especially, a positive positional limit is imposed upon each cant 21 advanced to the apparatus by the conveyor 20, and such limit is established by a stop 164 extending across the upper reach of the conveyor belt 22 so as to be abutted by each incoming cant. Accordingly, the longitudinal location of each cant 21 delivered to the apparatus is positively determined. Positively locating the cant 21 relative to the apparatus and adhesive applicators thereof is of significance as concerns disposition of the adhesive pattern along the cant so that the tail of each individual roll into which the cant is subsequently subdivided will be properly secured.

The stop 164 is generally in the form of an L-shaped bracket having a reinforcing web 165 to enable the bracket to withstand the repetitive impact forces occasioned by abutment of successive cants thereagainst. The bracket is welded or otherwiee fixedly secured to a mounting plate 166 adjustably attached to the front face of the end component 36 of the apparatus. In this reference, the plate 166 is provided with a plurality of longitudinally elongated slots 167 through which pass the mounting bolts 168 which are used to clamp the plate to the end component 36. It will be apparent that when the bolts 168 are loosened, the plate 166 and stop 164 attached thereto are adjustably displaceable in a longitudinal direction within the dimensional limits of the slots 167.

Also carried by the mounting plate 166 is a cycle-starting switch 169 which is essentially in the nature of a limit switch actuated in response to the displacements of an arm 170 supported for pivotal movement about a horizontal axis and in generally longitudinal directions, as viewed in FIG. 2. The arm 170 is resiliently biased by a torsion spring (not shown) circumjacent the pivotal support for the arm, and it is normally biased into the position shown in FIG. 2 in which the switch 169 is open. However, when a cant 21 is delivered to the apparatus by the conveyor 20, the cant engages the arm 170 and displaces the same in a counter-clockwise direction, as viewed in FIG. 2, thereby closing the switch 169 to initiate a cycle of operation. It will be evident that the maximum displacement of the arm 170 is established by abutment of the incoming cant with the stop structure 164.

A cycle of operation is initiated by energizing the apparatus, the controls for this purpose being provided along a control panel 171 located adjacent the upper edge of the end component 36, as shown in FIGS. 1 and 2. Conditioning the apparatus for operation includes supplying air under pressure thereto (which is adjusted to the desired delivery values by the controls 68 and 71 in conjunction with the gauges 67 and 70 respectively associated therewith), and supply of electricity to the motor 78 to rotate the shafts 27 and 28 and to the various heaters for the adhesive applicators 82. An on-off switch is provided on the control panel for the motor 78 and for the heater circuit. Each switch has an indicator light associated therewith, and a test switch which is also provided to energize an adhesive-ejection cycle so as to determine whether the adhesive is at proper temperature before a cant is delivered to the apparatus. In the particular embodiment of the apparatus being considered, the electric power supplied thereto may be 440-volt, AC, 3-phase, 60-cycle energy; and the pneumatic fluid supply is generally of the order of 80 psi at approximately 3 cubic feet per minute.

As the cant 21 is advanced toward the stop 164, it engages the switch system 170 so as to actuate the switch 169, and in response thereto the solenoid-controlled valve 51 is actuated, thereby energizing the air motor 47 so as to displace the pusher member 39 inwardly through a cycle of operation so as to displace the cant 21 from the infeed conveyor onto the rotating shafts 27 and 28, as depicted in FIGS. 8 through 10. It should be noted that the entire cycle of operation is under the control of a timer which enables the duration of each complete cycle of operation to be manually changed, and in the apparatus being considered, the time may be varied from between 5 to 10 seconds. At about the time that the pusher mechanism has returned to the original position thereof, the cycle timer energized the solenoid-controlled valve 72 to commence the discharge of air from the manifold 79 so as to unwind the tail 21*a* of the cant by accelerating the same, as shown in FIGS. 10 and 11.

When the tail of the cant is unwound, it extends along the platform 30, thereby overlying the opening 147 therein so as to interrupt the light path between the photosensitive device 145 and mirror 148, as shown in FIG. 11. The change in condition of the photosensitive device thereby occasioned causes the solenoid-controlled valve 72 to deenergize so as to terminate the gaseous discharge from the manifold 79.

Also, at about the time that the cant is being displaced into the apparatus by the pusher mechanism, the cycle timer causes the solenoid-controlled valves 143 to energize the air motors 141, thereby cocking the discharge nozzles 88 (compare FIGS. 9 and 10) by raising the same into the elevated position shown in FIG. 18 by lifting the actuator channel 139. Continued rotation of the cant 21 enforced thereon by the shafts 27 and 28 causes the tail 21*a* to be withdrawn from the light path between the photosensitve device 145 and its mirror or reflector 148 which results in the solenoid-controlled valves 143 deenergizing so as to quickly return the actuator channel 139 to its lower postion and enable the various springs 137 to return the nozzle plungers 131 to their normal position, thereby causing a measured or predetermined quantity of adhesive to be ejected from each nozzle onto the underlying cant, as illustrated in FIG. 13.

Figure 14:
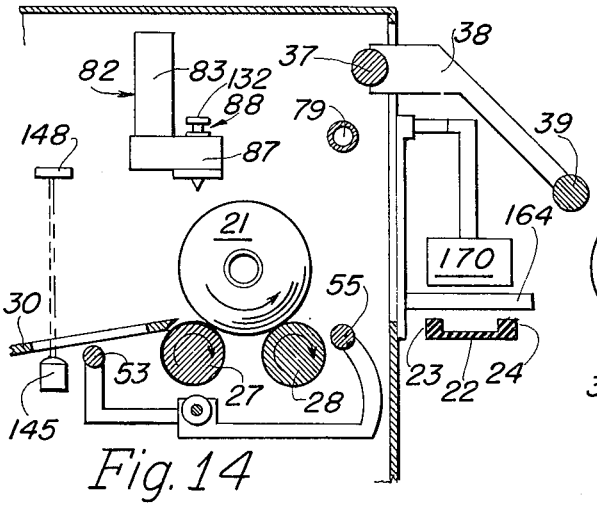
Figure 15:
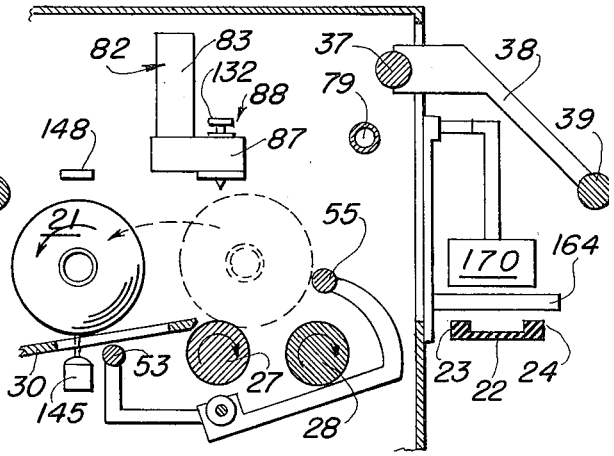

As the cant 21 continues to be rotated by the shafts 27 and 28, the tail 21*a* is rewound about the cant in overlying relation with the adhesive pattern which quickly secures the tail to the underlying convolution, and this condition of the apparatus is depicted in FIG. 14. Shortly thereafter, the control timer causes the solenoid-controlled valve 64 to be actuated which energizes the air motor 62 and causes the ejection mechanism including the bar 55 to displace the cant from the operating station onto the inclined platform 30 for delivery to cant-severing and roll-wrapping mechanisms. The timer then returns the ejection mechanism to its initial position, and the apparatus is then in condition for a subsequent cycle of operation.

The adhesive pattern provided along each cant 21 consists of a succession of 40 longitudinally spaced dots or spots of adhesive each constituting a predetermined quantity. The pattern can be adjusted along the length of the cant in at least two ways: first, by changing the position of the stop 164 and switch 169 by adjusting the location of the mounting plate 166; and second, by changing the relative positions of the four adhesive applicator modules 82. In the first instance, the entire pattern is shifted axially relative to the cant; and in the second, the relative disposition of the adhesive dots as between the respective modules is affected. The latter adjustment is accomplished, as heretofore explained, by loosening the handle structures 104 and 105 of a module and shifting it longitudinally within the limits previously noted from one spacially fixed location to another. This latter adjustment is especially useful in accommodating cants having different total lengths and in adjusting the glue pattern in accordance with the lengths of the individual products to be formed by severing the cant.

As previously explained, the adhesive used is a water soluble, hot-melt adhesive which sets quite rapidly, and a specific example thereof is No.EW-515 sold by the Baker Castor Ore Company. The heaters used in the various applicator modules 82 may take any conventional form such as Cromalox No.C427, 240-volt cartridge type units which may be associated with adjustable thermostats such as Cromalox No.17000. The solenoid-controlled valves, air motors and other similar components are all standard items old and well known in the art.

The apertures 80 of the gaseous discharge manifold 79 are disposed at an agle approximating 45° to either the vertical or horizontal, as previously explained; and in a more particular reference, it has been found that locating the same so that a diametral line through the center of the manifold and any aperture 80 intersects a cant 21 supported on the shafts 27 and 28 along a line spaced inwardly from the outer edge of the cant by approximately one-half inch. Since withdrawal of the tail 21*a* of each cant from the light path of the photosensitive cell 145 initiates the adhesive ejection cycle, it will be apparent that the position of the adhesive pattern along the cant 21 is necessarily related to the length of the tail 21*a* with a longer tail being provided when the cell is moved toward the left, as viewed in FIGS. 12 and 13, and vice versa. In all cases, however, the adhesive pattern comprises a plurality of discrete dots that are immediately covered by the cant tail as it is rewound, thereby protecting the apparatus and cant (and those cants to follow) from adhesive collections.

While in the foregoing specification an embodiment of the invention has been set forth in considerable detail for purposes of making a complete disclosure thereof, it will be apparent to those skilled in the art that numerous changes may be made in such details without departing from the spirit and principles of the invention.

What is claimed is:

1. Apparatus for securing the unaffixed tail of an elongated roll product to a convolution thereof underlying such tail, comprising: frame structure provided by said apparatus, roll-rotating mechanism supported by said frame structure and defining an operating station whereat said mechanism is adapted to freely support said roll product and continuously rotate said roll product about its longitudinal axis in a direction tending to wind said tail thereabout, means for positioning said roll product in an infeed position in transversely spaced relation with said operating station, selectively operable pusher mechanism for displacing said roll product from the infeed position thereof into said operating station, tail-accelerating means located at said operating station for unwinding such tail as the roll product is continuously rotated, selectively fixedly positioned longitudinally-extending spatially-fixed adhesive applicator structure including a plurality of spatially fixed dispensing nozzles disposed in longitudinally spaced relation along said apparatus and each being operative to eject a predetermined quantity of adhesive, said adhesive applicator structure carried by said frame structure at said operating station and in close proximity to said rotating roll product for directly depositing substantially aligned and discrete tail-securing adhesive spots at predetermined locations on the underlying convolution of such roll product during rotation thereof, said discrete adhesive spots adapted to be positioned between said tail and said underlying convolution when the tail is rewound due to the continuous rotation of the roll product by said roll-rotating mechanism, and selectively operable ejection mechanism essentially independent of said roll-rotating mechanism for displacing said roll product from the operating station after said tail has been rewound thereon and adhesively secured to the convolution underlying the same, said adhesive applicator structure comprising a plurality of separate adhesive applicator modules disposed in spaced apart longitudinal succession along said operating station and each equipped with a plurality of spatially-fixed dispensing nozzles disposed in longitudinally spaced relation, and means adjustably securing each of said modules to said frame structure to enable the relative longitudinal positions of the patterns of adhesive respectively deposited by said modules to be altered to accommodate variations in the lengths of the individual rolls into which such elongated roll products may be subdivided.

2. The apparatus of claim 1 and further comprising a plurality of attachment means respectively provided by said modules for removably mounting each as a unit on said frame structure and including at least in part the aforesaid means for adjustably securing said modules to said frame structure.

3. The apparatus of claim 2 in which each of said attachment means includes a pair of handle structures respectively disposed adjacent opposite end portions of said applicator modules to permit the same to be lifted and otherwise manipulated and carried, said handle structures being equipped with fastener structure to enable the module associated therewith to be removably mounted on said frame structure as aforesaid, in which each of said handle structures is rotatably supported by the associated applicator module, and in which said fastener structure includes elements carried by each handle structure and angularly displaceable therewith to removably secure the associated applicator module to said frame structure.

4. The apparatus of claim 2 in which each of said nozzles is provided with a plunger axially reciprocable between adhesive-filling and adhesive-ejection positions, in which said apparatus is equipped with reciprocable actuator structure connected with said plungers for actuatingg a cycle of operation thereof, and in which each plunger is removably connected with said actuator structure to enable each nozzle to be removed from said apparatus.

5. Apparatus for securing the unaffixed tail of an elongated roll product to a convolution thereof underlying such tail, comprising: frame structure provided by said apparatus, roll-rotating mechanism supported by said frame structure and defining an operating station whereat said mechanism is adapted to freely support said roll product and continuously rotate said roll product about its longitudinal axis in a direction tending to wind said tail thereabout, means for positioning said roll product in an infeed position in transversely spaced relation with said operating station, selectively operable pusher mechanism for displacing said roll product from the infeed position thereof into said operating station, tail-accelerating means located at said operating station for unwinding such tail as the roll product is continuously rotated, selectively fixedly positioned longitudinally-extending spatially-fixed adhesive applicator structure including a plurality of spatially fixed dispensing nozzles disposed in longitudinally spaced relation along said apparatus and each being operative to eject a predetermined quantity of adhesive, said adhesive applicator structure carried by said frame structure at said operating station and in close proximity to said rotating roll product for directly depositing substantially aligned and discrete tail-securing adhesive spots at predetermined locations on the underlying convolution of such roll product during rotation thereof, said discrete adhesive spots adapted to be positioned between said tail and said underlying convolution when the tail is rewound due to the continuous rotation of the roll product by said roll-rotating mechanism, and selectively operable ejection mechanism essentially independent of said roll-rotating mechanism for displacing said roll product from the operating station after said tail has been rewound thereon and adhesively secured to the convolution underlying the same, each of said nozzles being provided with a plunger axially reciprocable between adhesive-filling and adhesive-ejection positions, said apparatus being equipped with reciprocabble actuator structure connected with said plungers for actuating a cycle of operation thereof, and each of said nozzles being equipped with a spring resiliently biasing the plunger toward the adhesive-ejection position thereof, said actuator structure being operative to displace each plunger against the biasing force of its spring and thereafter to release the plunger to enable return thereof to such ejection position under the force of its associated spring.

6. The apparatus of claim 5 in which each plunger is removably connected with said actuator structure to enable each nozzle to be removed from said apparatus.

7. Apparatus for securing the unaffixed tail of an elongated roll product to a convolution thereof underlying such tail, comprising frame structure provided by said apparatus, roll-rotating mechanism supported by said frame structure and defining an operating station whereat said mechanism is adapted to freely support said roll product and continuously rotate said roll product about its longitudinal axis in a direction tending to wind said tail thereabout, means for positioning said roll product in an infeed position in transversely spaced relation with said operating station, selectively operable pusher mechanism for displacing said roll product from the infeed position thereof into said operating station, tail-accelerating means located at said operating station for unwinding such tail as the roll product is continuously rotated, selectively fixedly positioned longitudinally-extending spatially-fixed adhesive applicator structure including a plurality of spatially fixed dispensing nozzles disposed in longitudinally spaced relation along said apparatus and each being operative to eject a predetermined quantity of adhesive, said adhesive applicator structure carried by said frame structure at said operating station and in close proximity to said rotating roll product for directly depositing substantially aligned and discrete tail-securing adhesive spots at predetermined locations on the underlying convolution of such roll product during rotation thereof, said discrete adhesive spots adapted to be positioned between said tail and said underlying convolution when the tail is rewound due to the continuous rotation of the roll product by said roll-rotating mechanism, and selectively operable ejection mechanism essentially independent of said roll-rotating mechanism for displacing said roll product from the operating station after said tail has been rewound thereon and adhesively secured to the convolution underlying the same, said adhesive structure comprising a plurality of separate adhesive applicator modules each having an adhesive reservoir and being removably secured as a unit to said apparatus, said nozzles being respectively associated with said modules and carried thereby for removable securance therewith to said apparatus, each of said nozzles being provided with a plunger axially reciprocable between adhesive-filling and adhesive-ejection positions, and said apparatus being equipped with reciprocable actuator structure connected with said plungers for actuating a cycle of operation thereof, each plunger being removably connected with said actuator structure to enable each nozzle to be removed from said apparatus.

* * * * *